US005771531A

United States Patent [19]

Swartz

[11] Patent Number: 5,771,531

[45] Date of Patent: Jun. 30, 1998

[54] VACUUM FOR ANIMAL FECES

[76] Inventor: Donna Swartz, 686 Frisco, Augusta, Kans. 67010

[21] Appl. No.: 752,146

[22] Filed: Nov. 19, 1996

[51] Int. Cl.[6] ..... A47L 5/24

[52] U.S. Cl. ..... 15/344; 15/324

[58] Field of Search ..... 15/324, 344, 350, 15/352; 55/318, 350.1, DIG. 3

[56] References Cited

U.S. PATENT DOCUMENTS

| | | | |
|---|---|---|---|
| 1,255,662 | 2/1918 | Sullivan | 15/344 |
| 2,637,062 | 5/1953 | Sutton et al. | 15/324 |
| 2,729,303 | 1/1956 | McMahan | 183/37 |
| 3,866,264 | 2/1975 | Engquist | 15/421 |
| 4,011,624 | 3/1977 | Proett | 15/344 |
| 4,185,355 | 1/1980 | Williams | 15/344 |
| 4,206,864 | 6/1980 | Rauchwerger | 228/20 |
| 4,478,448 | 10/1984 | Albert | 294/1 BA |
| 4,549,329 | 10/1985 | St. Clair | 15/353 |
| 4,570,286 | 2/1986 | Ross | 15/344 |
| 4,796,327 | 1/1989 | Doyen | 15/340.3 |

*Primary Examiner*—Diana Biefeld
*Attorney, Agent, or Firm*—Foley & Lardner

[57] ABSTRACT

A vacuum is described which includes a housing having first, second, and third openings, a vacuum motor connected to the first opening of the housing, an elongated tube connected by one end to the second opening of the housing, and a receptacle removably connected to the third opening of the housing. The vacuum is useful for the removal and disposal of animal feces.

14 Claims, 1 Drawing Sheet

VACUUM FOR ANIMAL FECES

U.S. Pat. No. 4,478,448 discloses an animal excrement removal device featuring a spring-loaded piston that creates a vacuum when triggered to generate a suction through the end of an elongated tube which pulls in animal excrement near the end of the tube. The animal excrement is pulled in only a short distance where it is held in a receptacle at ground level near the end of the elongated tube. The device would require substantial strength to operate the spring-loaded piston and, moreover, does not allow easy removal of the animal feces, which must be retrieved from the end of the elongated tube at ground level.

U.S. Pat. No. 4,185,355 discloses a hand-held vacuum with a downward facing opening at one end that must be placed virtually on top of the animal feces in order to pick them up. The vacuum includes an internal receptacle bag that receives and holds the feces. The structure of the vacuum requires the user to bend over and place the entire unit almost flat on the ground when picking up feces. Moreover, in order to remove the receptacle bag that receives and holds the animal feces after they are sucked through the opening, a user must remove the front half of the housing to gain access to the bag. The bag is removed and must be replaced with a new bag. The operation of this vacuum is manifestly cumbersome.

SUMMARY OF THE INVENTION

The present invention provides a hand-held device for retrieving animal feces that does not require bending over and includes an easily accessible and removable receptacle. The device includes an elongated tube, one end of which is connected to a housing, the other end of which is used to pick up animal feces. The housing fits over the end of a portable vacuum motor and further includes the removable receptacle that holds the animal feces.

DETAILED DESCRIPTION OF THE INVENTION

Figure 1:
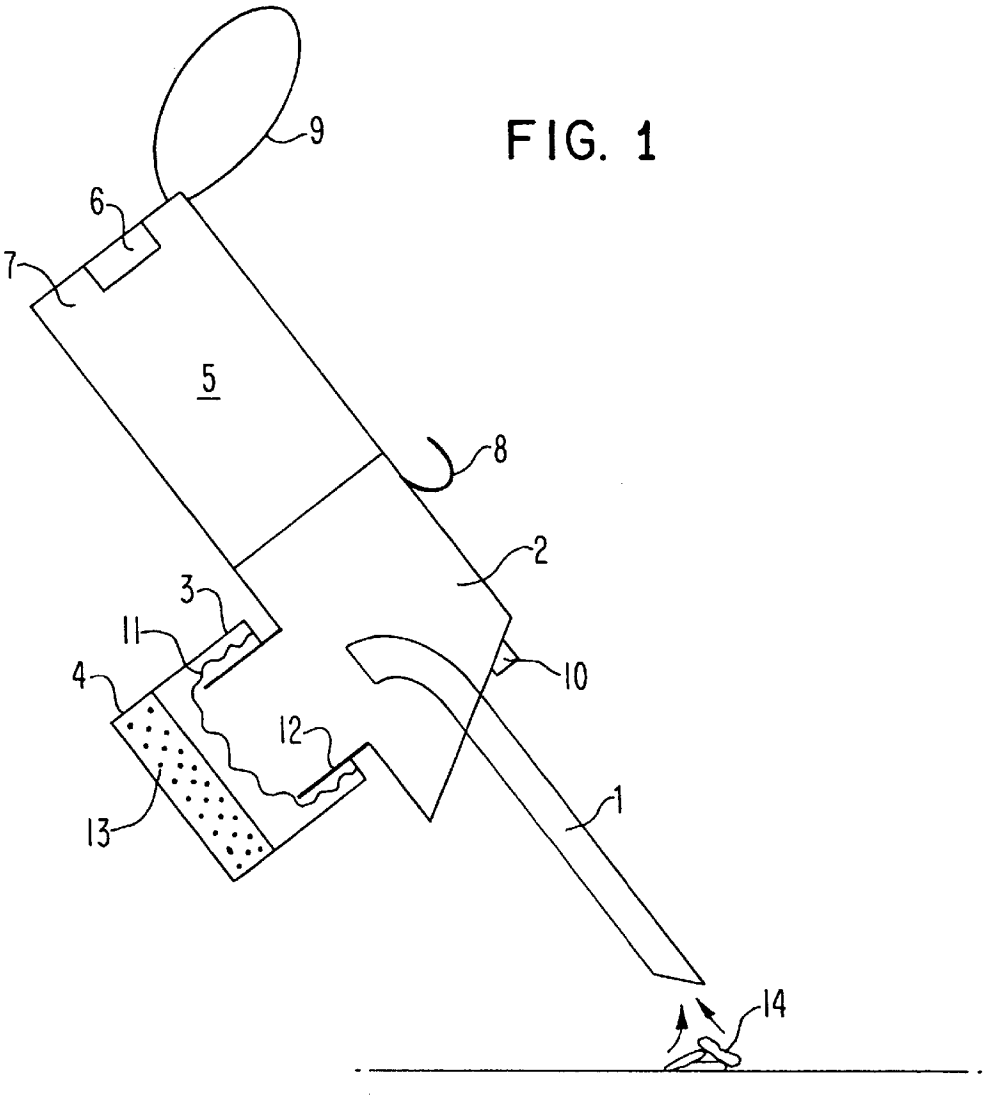
FIG. 1 shows a side view of the vacuum of the present invention.

As shown in FIG. 1, the device includes an elongated tube 1, one end of which is connected to a housing 2, the other end of which is used to pick up animal feces 14. The housing 2 fits over the end of a portable electrically powered vacuum motor 5 and further includes a removable receptacle 3 on an underside of the housing that receives and holds the animal feces 14 after they are picked up by the elongated tube 1 and drawn by suction into the housing 2 where they drop into the receptacle 3.

Preferably, the housing 2 is made of plastic. The housing 2 comprises three openings. One opening on the housing receives the end of the elongated tube 1. A second opening is the point of attachment for the feces receptacle 3. The third opening is that by which the housing is connected to the vacuum motor 5. The openings preferably allow substantially air-tight connection of the housing to the tube 1, to the receptacle 3, and to the vacuum motor 5. Preferably, the connections can be formed by a friction fit or by a twist-lock connection so that the parts are easily detachable. Optionally, the substantially air-tight connections may include a gasket or rubber O-ring to minimize vacuum loss. Optionally, a C-shaped clip 8 is provided on the housing 2 which allows a user to remove the tube 1 when not in use and clip onto the housing 2 for storage.

Preferably, the elongated tube 1 is made of plastic and has a diameter that is sufficient to accommodate animal feces 14 therein, allowing them to be drawn through the tube 1 by suction. When the tube 1 is detachable, it can be detached for easy cleaning, for example, by running water from a hose through one end to flush out debris.

The vacuum motor 5 can be any such motor known in the art having sufficient power to draw animal feces 14 up the tube 1 and into the receptacle 3. Preferably, the vacuum motor 5 is a portable, electrically powered wet/dry vacuum run by a battery 6. The battery 6 may be rechargeable or disposable. Alternatively, the vacuum motor 5 may be powered through an electrical supply cord 7. A particularly preferred vacuum motor 5 is the Hoover wet/dry vacuum, Series 300, Model # S1117-900. Another suitable vacuum motor 5 is a leaf blower motor which can be reversed to create suction. Leaf blower motors are typically electric or gas-burning.

The receptacle 3 is preferably made of plastic and attaches to a circular rim 12 of the housing 2 by means of screw-in threads. Alternatively, as mentioned above, the connection can be formed by friction fit or twist-lock attachment. Optionally, the receptacle 3 is lined with a bag 11 that is folded over the top edge of the receptacle 3 and screwed into the screw-in threads of the circular rim 12. In this embodiment, it is preferable for the circular rim 12 to extend downward inside the bag 11 a sufficient distance so that, when the vacuum motor 5 is activated, the suction will not pull the bag up into the housing 2. Alternatively, the bottom of the bag 11 may be secured to the bottom of the receptacle 3 by suitable adhesive means to prevent it from being sucked up into the housing 2.

It is also possible to fasten the bag 11 around the circular rim 12 without using the receptacle 3. For example, the bag may be tied with a fastener around the circular rim 12 or it may be secured by means of a ring-shaped fastener, such as a rubber band. In this embodiment, it is also preferable to have the circular rim 12 extend far enough into the bag to prevent it from being sucked up into the housing 2.

The bag 11 is preferably made of a water-tight, biodegradable material. The bag 11 can also be made of plastic. When the receptacle 3 is filled with animal feces 14, it is removed from the housing 2 and the bag 11 is easily removed from the receptacle 3 and thrown away. A new bag 11 is added to the receptacle 3 and re-attached. This embodiment is advantageous because the receptacle 3 never becomes dirty. The only part which needs to be cleaned is the tube 1.

Optionally, the receptacle 3 includes a container 4 that removably attaches to the underside of the receptacle 3. The container 4 is preferably plastic and is filled with water-absorbable particles 13 that can be sprinkled onto watery feces to cause clumping for easier pick-up by the vacuum. Preferably, the water-absorbable particles 13 are cat litter.

Optionally, the vacuum of the invention includes a shoulder strap 9 to support the weight of the vacuum on a user's shoulder. Optionally, the vacuum may further include a light 10 to illuminate dim or dark areas in front of the tube 1.

The advantages of the present invention include its lightweight construction and ease of use. The vacuum may be used indoors or outdoors. The only part which needs cleaning is the tube 1 when a disposable bag 11 is used, which keeps the receptacle 3 from becoming dirty. The tube 1 can be easily cleaned by running water through one end. Also, a user can easily reach the receptacle 3 and remove it and then remove the bag 11 to throw it away without ever contacting the animal feces 14.

It will be apparent to those skilled in the art that various modifications and variations can be made to the compositions and processes of this invention. Thus, it is intended that the present invention cover such modifications and variations, provided they come within the scope of the appended claims and their equivalents.

The disclosures of all publications cited above are expressly incorporated herein by reference in their entireties to the same extent as if each were incorporated by reference individually.

I claim:

1. A device comprising a housing having first, second, and third openings, a vacuum motor connected to the first opening of the housing, an elongated tube connected by one end to the second opening of the housing, and a receptacle removably connected to the third opening of the housing, wherein the third opening is positioned between said first and second openings and below said second opening, said housing including an empty space between said second and third openings so that material drawn through the elongated tube by the vacuum motor passes without obstruction into the receptacle.

2. The device of claim 1, wherein the vacuum motor is a wet/dry vacuum.

3. The device of claim 2, wherein the housing includes a C-shaped clip on an outer side that receives and holds the elongated tube when not in use.

4. The device of claim 2, wherein the vacuum motor is powered by at least one rechargeable or disposable battery.

5. The device of claim 2, wherein the receptacle is a bag.

6. The device of claim 1, which further comprises a shoulder strap.

7. The device of claim 1, which further comprises a light to illuminate dim or dark areas in front of the elongated tube.

8. The device as claimed in claim 1, wherein the vacuum motor is removably connected to the first opening of the housing.

9. The device as claimed in claim 1, wherein the elongated tube is removably connected to the second opening of the housing.

10. A device comprising a housing having first, second, and third openings, a wet/dry vacuum motor connected to the first opening of the housing, an elongated tube connected by one end to the second opening of the housing, and a receptacle removably connected to the third opening of the housing, wherein the third opening of the housing is a circular rim and the receptacle includes screw-in threads for attachment to the circular rim.

11. The device of claim 10, wherein the receptacle is lined with a disposable bag.

12. The device of claim 11, wherein the bag is made of a water-tight, biodegradable material.

13. A device comprising a housing having first, second, and third openings, a wet/dry vacuum motor connected to the first opening of the housing, an elongated tube connected by one end to the second opening of the housing, and a receptacle removably connected to the third opening of the housing wherein the receptacle further includes a container containing water-absorbable particles that removably attaches to the receptacle.

14. A method of removing animal feces, comprising the steps of providing a housing having first, second, and third openings, a vacuum motor connected to the first opening of the housing, an elongated tube connected by one end to the second opening of the housing, and a receptacle removably connected to the third opening of the housing, wherein the third opening is positioned between said first and second openings and below said second opening, said housing including an empty space between said second and third openings so that material drawn through the elongated tube by the vacuum motor passes without obstruction into the receptacle, bringing the elongated tube in close proximity to animal feces and activating the vacuum motor.

* * * * *